United States Patent [19]

Manizza

[11] 4,314,640

[45] Feb. 9, 1982

[54] BOTTLE PACKAGE

[75] Inventor: Guelfo A. Manizza, Blauvelt, N.Y.

[73] Assignee: Federal Paper Board Company, Inc., Montvale, N.J.

[21] Appl. No.: 149,350

[22] Filed: May 13, 1980

[51] Int. Cl.[3] ..... B65D 85/62; B65D 75/08

[52] U.S. Cl. ..... 206/434; 229/40

[58] Field of Search ..... 206/434; 229/40

[56] References Cited

U.S. PATENT DOCUMENTS 3,339,723 9/1967 Wood ..... 229/40

3,670,950 6/1972 Rossi ..... 229/40

*Primary Examiner*—William T. Dixson, Jr.

*Attorney, Agent, or Firm*—Guy A. Greenawalt

[57] ABSTRACT

A wraparound type carrier package for a group of bottles which are arranged in a double row and in transversely aligned pairs, which package is formed by wrapping about the top, sides, ends and bottom of the bottles, a cut and scored blank of paperboard, or similar foldable sheet material, which blank is divided into top, side and bottom wall forming panels with the top and side wall panels having hinged end wall closure forming panels, which end closure forming panels have interengaging locking elements on their free margins, the latter being adapted, when the package is formed by wrapping the blank about a group of bottles and engaging the locking elements on their free margins and engaging the locking elements on the infolded end closure panels, to hold the latter in end closing position.

12 Claims, 15 Drawing Figures

BOTTLE PACKAGE

BACKGROUND OF THE INVENTION

This invention relates to carrier cartons for packaging groups of articles, particularly bottled beverages, of the type which require minimum exposure to light to avoid quality deterioration and is more particularly concerned with improvements in a carrier carton structure which is derived by wrapping a cut and scored blank of paperboard, or similar foldable sheet material, about the top, sides and bottom of a group of the articles so as to form an article encasing tube and having hinged panels on the end edges of the tube walls which are held in closed position by interengaging locking elements.

In the marketing of bottled beverages, and products, of similar character many carrier cartons have been developed which are derived by folding or wrapping about a group, or assembly, of the bottled products, a cut and scored blank of paperboard, or similar foldable sheet material, and securing overlapped margins of the end panels in the blank, generally by means of an adhesive or interengaging locking elements. In packaging soft drinks and other products which are not subject to deterioration, or change in character, when exposed to light for a substantial length of time, the tubular carton formed in this manner is normally fabricated with open ends, so as to save material. However, in packaging bottled beer, for example, which suffers a loss in quality when exposed to light for a lengthy period, it is desirable that the ends of the tubular wrapper be closed so that the end bottles have minimum exposure to light. U.S. Pat. No. 3,670,950, granted to Harry J. Rossi, on June 20, 1972, discloses a wraparound type tubular package with opposite ends closed by so-called "barn door" panels which are hinged to the sidewalls and connected to bottom wall panels by integral foldable web members. The end closure panels are held in closure forming position by the connecting webs at the bottom, and, at the top, by a narrow panel which is hinged to the end edge of the top wall panel and connected to the sidewalls by web elements and folds down over the top margins of the closure panels. Generally, this top end panel will also serve as an identification panel.

In designing this type package, there has always been the problem of how to provide a tight wrapped package using minimum material and having end closure panels which will be held securely in closure forming position, so as to insure that the bottles will be protected at the ends of the package and not exposed to light during normal handling of the package.

It is a general object of the present invention to provide an improved packaging arrangement for articles having the general form of beverage bottles in which a blank of paperboard or similar foldable sheet material is cut, scored and folded into tubular configuration about the top, sides and bottom of a group of articles arranged in side-by-side relation, with the end margins of the blank being overlapped and secured by interengaging locking elements, so as to form a tightly wrapped, tubular enclosure for the bottles, and with cooperating end closure panels which are hinged to the sidewalls and securely held in fully closed position by a narrow hinged end panel which is folded down from the end edge of the top wall with the margin overlapping margins of the end closure panels and connected in interlocked relation with portions of the end closure panels.

A more specific object of the invention is to provide a carrier carton type package for articles, particularly, bottled products wherein the carton is formed by enclosing an assembly of the bottles in a wraparound blank of paperboard, or the like, which is cut and scored to provide connected wall forming panels including top, side, bottom and end walls, and wherein the bottom wall forming panels are connected in tightly drawn relation by cooperating interengaging locking and latching elements and the end closure forming panels are securely held by a double latch arrangement so as to insure that all the panels are securely held in fully closed, carton forming position during normal handling.

A further object of the invention is to provide in a package of the type described, an improved end closure panel arrangement which is relatively simple, which requires minimum material and minimum alteration in existing automatic machinery for fabricating this type package and which provides double latching, positive retention of the end wall panels in end closing position.

The invention as claimed herein is embodied in a bottle enclosing package formed with a wraparound type blank of foldable sheet material which is adapted to fully enclose a group of the bottles which are arranged in double row transversely paired relation, the carton when formed having integral top, side and bottom walls disposed in tube forming configuration and with end closure panels hinged to opposite ends of the sidewalls and retained in closed position at each end of the package by interengaging latching elements and a panel depending from the end edge of the top wall and having interlocking engagement with top marginal portions of the closure panels.

The aforesaid objects and other objects and advantages of the invention will become more apparent when reference is made to the accompanying detailed description of the preferred embodiment of the invention, which is set forth therein by way of example, and shown in the drawings, wherein like reference numerals indicate corresponding parts throughout.

DESCRIPTION OF THE PREFERRED EMBODIMENTS OF THE INVENTION

Figure 1:
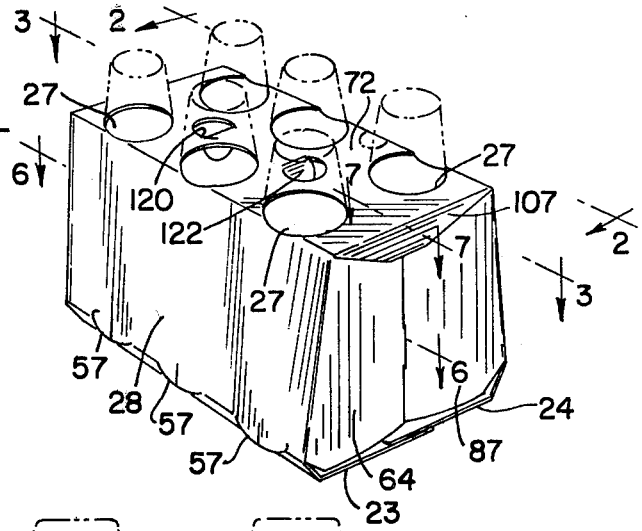
FIG. 1 is a perspective view of a bottle carrier type package which embodies the principles of the invention with top portions of the bottles being indicated in phantom line.
Figure 2:
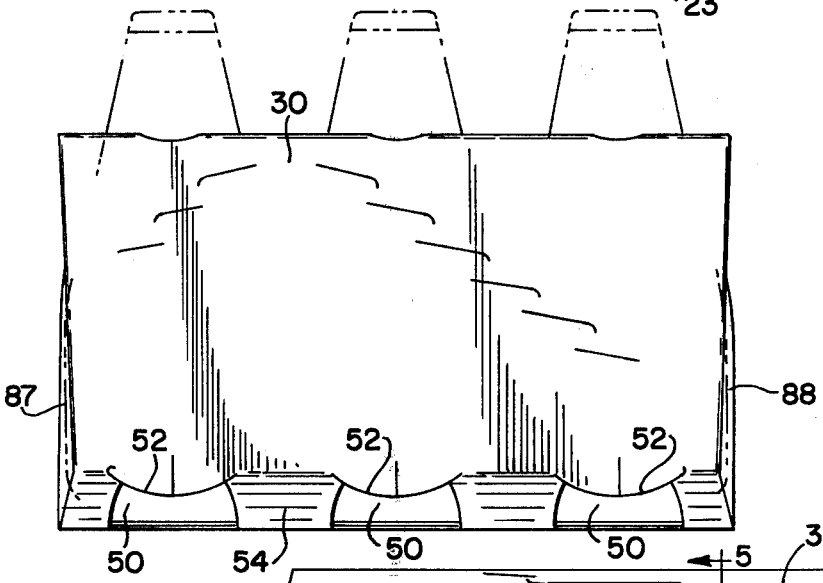
FIG. 2 is a side elevational view of the package of FIG. 1, the view being taken on the line 2—2 of FIG. 1, to a larger scale.
Figure 3:
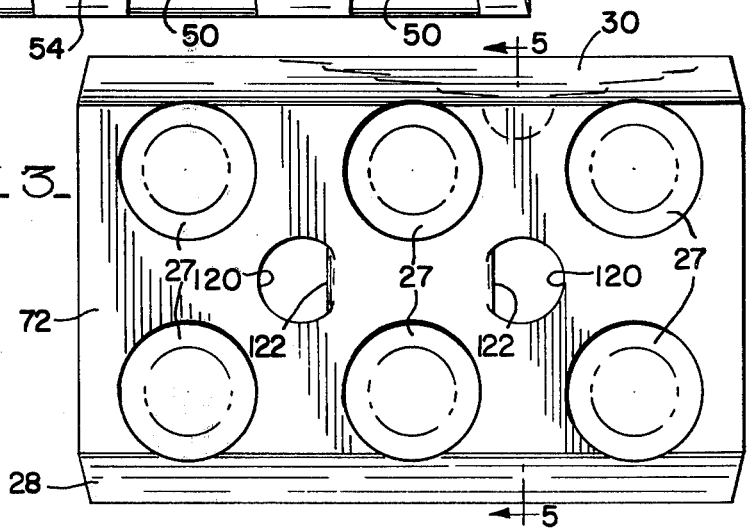
FIG. 3 is a top plan view of the package taken on the line 3—3 of FIG. 1, to a larger scale.

Referring to FIGS. 1 to 11 of the drawings, there is illustrated a carrier carton type six bottle package and a cut and scored blank of paperboard, or similar foldable sheet material, for forming a package, which embodies the principal features of the invention. It will be understood that the principles of the invention may be otherwise applied and that the following description of the carrier cartons, as shown in the drawings, is for the purpose of setting forth the forms of the invention which are presently preferred.

Figure 11:
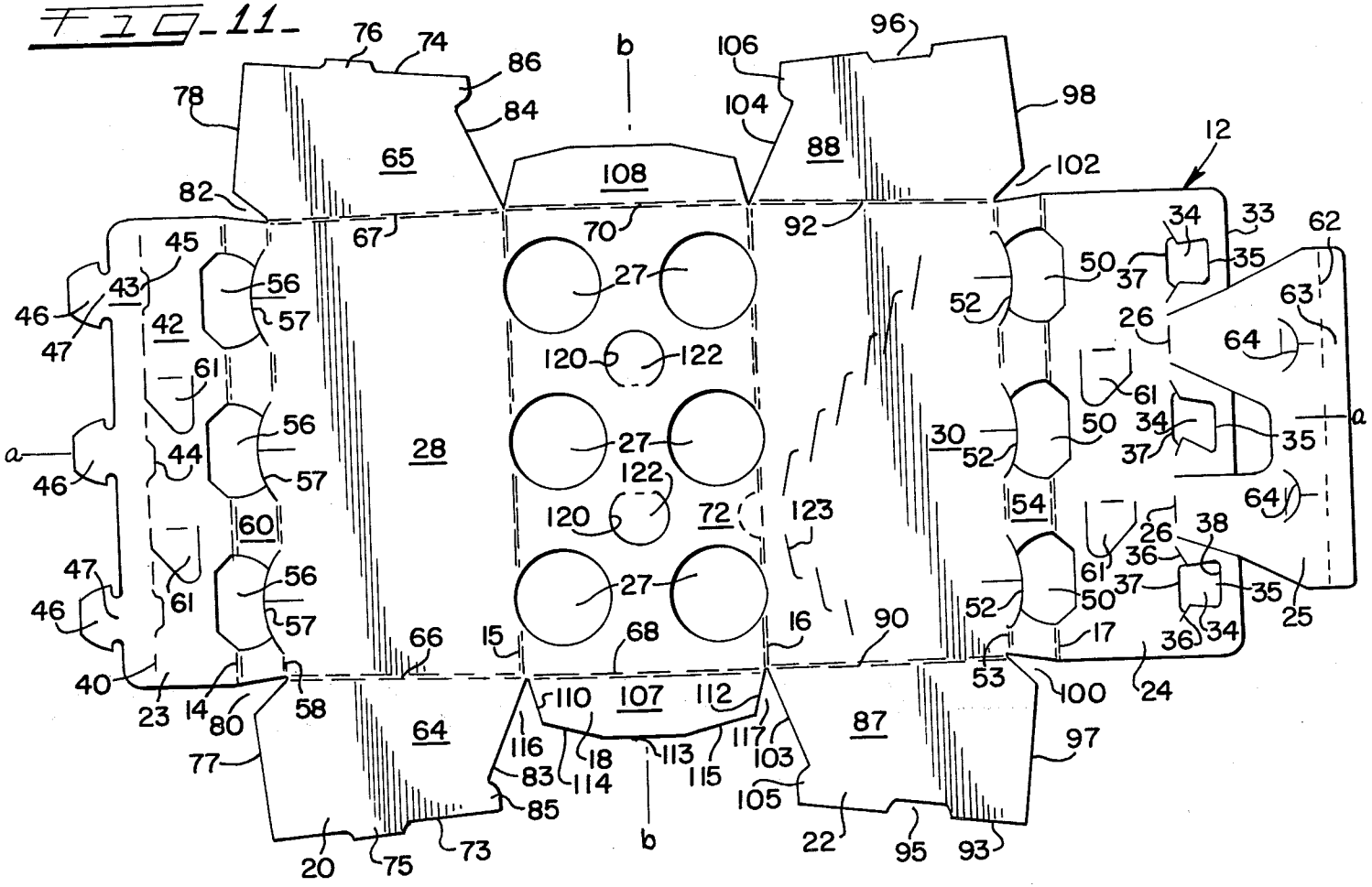
FIG. 11 is a plan view showing the outside face of a carton forming blank which is cut and scored for wrapping about an assembly of bottles to form the package illustrated in FIG. 1.

The carton structure 10 which is illustrated in FIGS. 1 to 10 is formed by wrapping the cut and scored blank 12 of FIG. 11 about an assembly of beverage bottles B which are arranged in two rows of three bottles each with the bottles in transversely paired alignment. The blank 12, which is of paperboard, or similar foldable sheet material, of suitable gauge or weight, is cut and scored as shown in FIG. 11, so as to divide it into wall forming panels and associated panel connecting means, together with bottle movement restraining means. Except for certain details hereinafter referred to, the blank 12 is symmetrical about longitudinal and transversely extending center lines which are indicated at a—a and b—b in FIG. 11. It is divided on parallel, longitudinally spaced, transversley extending hinge forming crease or score lines 14, 15, 16 and 17, into top wall forming center panel section 18, adjoining sidewall forming panel sections 20 and 22, and bottom wall forming panel sections 23 and 24, the latter being at opposite end margins of the blank 12, and the one end panel 24 having a partition forming extension panel 25 which is cut and scored so as to enable it to hinge on transversely extending and transversely aligned hinge scores 26. The center panel section 18 of the blank, in which a top wall and associated panels are formed, has a dimension in the direction longitudinally of the blank, which corresponds approximately to the distance between the outside edges of the neck portions of a pair of transversely aligned bottles at a predetermined level below the capped tops of the bottles so that two rows of circular apertures 27 may be cut therein which are longitudinally and transversely spaced to enable portions of the necks of the bottles to be seated therein as shown in FIG. 1. The dimensions of the sidewall forming panels 28 and 30 in the direction longitudinally of the blank, correspond generally to the height of the main body portions of the bottles B. The top portions of the bottles shown are covered by an opaque label. The transverse dimension of the bottom wall forming end panel sections 23 and 24, which support the bottles in the package form, corresponds approximately to the bottom dimension of the rows of bottles B, when grouped as indicated in FIG. 1. The top wall forming panel section 18 and the adjoining sidewall forming panel sections 20 and 22 have an overall transverse dimension which is greater than the row dimension of the bottle assembly and these panels are subdivided, as hereinafter described, so as to provide along opposite sides of the blank hinged panel structures for closing the ends of the tubular carton which results when the blank 12 is folded and secured in bottle enclosing relation.

The bottom wall forming end panels 23 and 24 in the blank 12 have a dimension in the lengthwise direction of the blank sufficient to provide overlapping marginal portions when they are in carton forming position and cooperating interengaging locking elements are cut therein for securing the two panels in wall forming relation and to provide a tight wrap about the bottle assembly. The bottom wall forming panel 24, which is rectangular in form, extends between the carton bottom corner forming score line 17 and the parallel edge defining line 33 of the panel and a plurality of spaced, transversely aligned latch receiving apertures 34 are cut therein, there being three in the illustrated form of the blank, which corresponds to the number of bottles in a row. The apertures or latch receiving openings 34, which may be termed the female locking elements, are each in the form of a truncated triangle. They are each defined by cutting lines, which may be shown in U.S. Pat. No. 4,029,204 granted June 14, 1977, and in U.S. Pat. No. 3,670,950, granted June 20, 1972. Each latch opening or aperture 34 is defined by a generally U-shaped main cutting line 35 which opens inwardly of the panel 24 with short terminal leg portions 36 in diverging relation and with an inner connecting base line 37 extending transversely between the cutting lines 36 and spaced inwardly of the transversely extending base portion 38 of the U-shaped cutting line 35. The end panel section 23 at the opposite end of the blank 12 is divided by a transverse score line 40, which is parallel with the score line 14 and spaced therefrom, so as to provide a bottom wall forming portion 42 and a terminal latch bearing portion 43. The score line 40 is interrupted by a series of transversely spaced, relatively short cutting lines 44 which are generally C-shaped and extend into the panel 42, with the terminal ends thereof reversely curved, so as to form primary locking tabs 45. The tabs 45 are longitudinally aligned with female apertures 34 for engagement in the latter at the outermost edges 38 thereof. Secondary locking or latching tabs, or fingers 46, are provided in longitudinal alignment with the locking tabs 45, which are spaced along the opposite free edge of the panel 42 and have a configuration which includes a neck portion 47 of reduced width corresponding, approximately, to the width of the apertures 34 at the innermost edge 37 thereof. The locking and latching tabs and cooperating apertures may be formed as shown in U.S. Pat. No. 4,029,204; U.S. Pat. No. 3,598,593, granted June 29, 1971; and U.S. Pat. No. 3,432,029, granted Mar. 11, 1969.

The transverse score line 17, which defines the edge of the bottom wall forming panel 24, is interrupted by transversely spaced bottle movement restraining apertures 50, which are spaced according to the bottle spacing in the rows and which are longitudinally aligned in the blank with the locking and latching tabs 45 and 46. The innermost edge of each aperture 50 is defined by a curved cutting line 52 which is in the form of a segment of a circle and which is bowed in the direction of the end of the blank. These cutting lines interrupt a transverse score line 53 which is parallel with and spaced inwardly of the transverse score line 17 and which cooperates with the latter in forming a narrow bottom corner edge panel 54 in the final package. The apertures 50, in which bottom edge portions of the bottles seat, may be in the form shown in U.S. Pat. No. 4,029,204. At the other end of the blank 12, the bottom edge forming score line 14 is interrupted by transversely spaced bottle retaining apertures 56 which have inboard edges formed by outwardly bowed or curved cutting lines 57 which interrupt a transverse score line 58 spaced inwardly from, and parallel with, the score line 14 so as to form a narrow bottom edge panel 60. This arrangement is formed the same as the apertures 50 in panel 54 at the opposite end of the blank, and provides like bottle movement restraining means for the row of bottles on that side of the assembly. The bottom wall forming panels 23 and 24 are each cut and scored to provide hinged separator tabs 61 which are spaced according to the spacing of the bottles in the rows and which may be formed as shown in U.S. Pat. No. 4,029,204 and hinged upwardly for disposition as separators between the bottles at the bottoms thereof.

Figure 5:
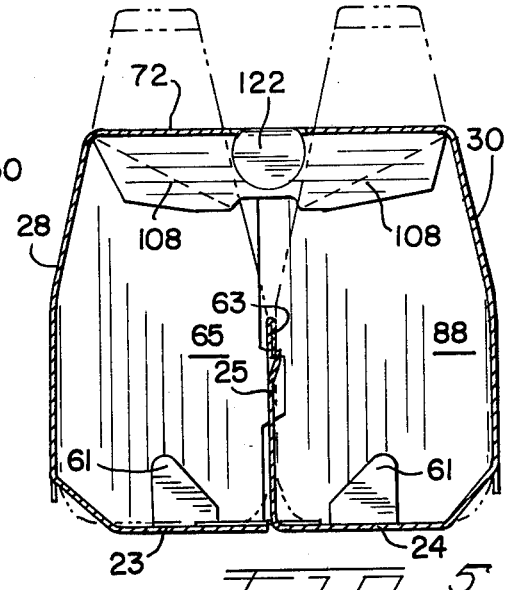
FIG. 5 is a cross-sectional view taken on the line 5—5 of FIG. 3.
Figure 6:
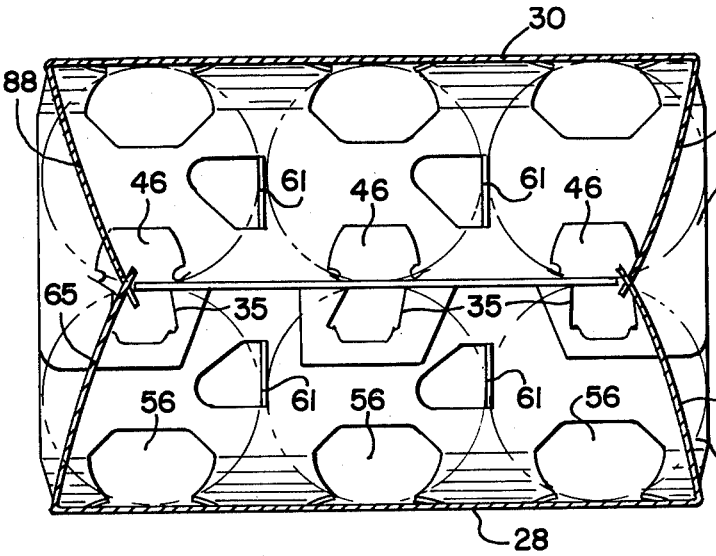
FIG. 6 is a sectional view taken on the line 6—6 of FIG. 1, to a larger scale.
Figure 7:
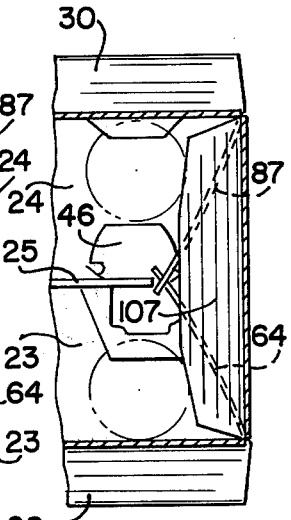
FIG. 7 is a fragmentary sectional view taken on the line 7—7 of FIG. 1, to a larger scale.
Figure 8:
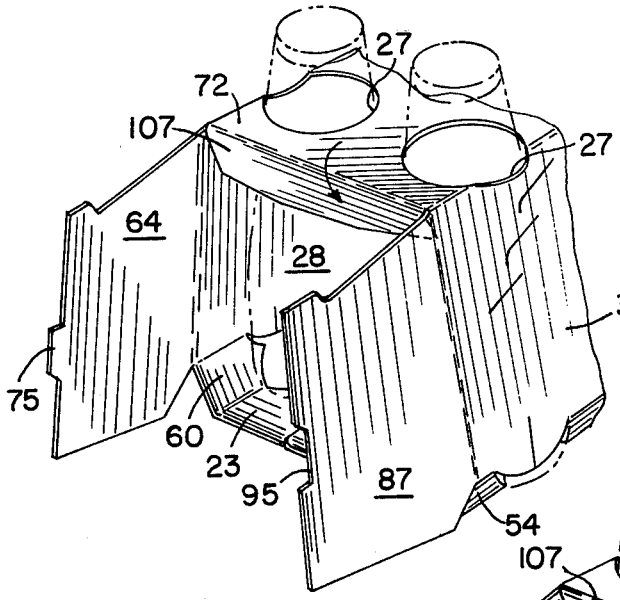
FIG. 8 is a perspective view of an end portion of the carrier illustrating initial steps in closing the end panels.
Figure 9:
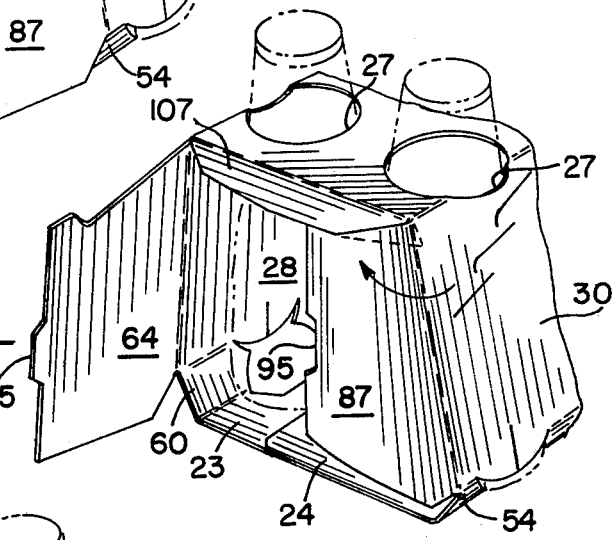
FIG. 9 is a perspective view similar to FIG. 8 illustrating further steps in closing the end panels.
Figure 10:
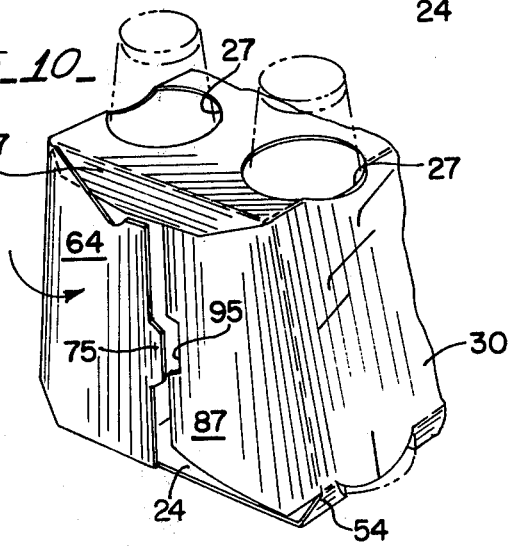
FIG. 10 is a perspective view similar to FIG. 8 illustrating the final steps in closing the end panels.

The partition forming panel 25, which constitutes an extension portion on the panel 24, is of lesser transverse dimension than the panel 24, and is adapted to form a divider between the rows of bottles as shown in FIGS. 5 and 6, the transverse dimension being somewhat greater than the distance between the vertical axes of the end bottles in the rows. The panel 25 is cut so as to have a generally U-shaped configuration with the main portion extending outboard of the cutting line 33 and is adapted to hinge on the transverse score line 26 which is spaced from the score line 17 so that when it is hinged to upright position relative to panel 24, it will be disposed between the two rows of bottles. A score line 62 sets off a narrow marginal strip 63 which is reversely folded to provide a double thickness at the margin. A pair of C-shaped cuts 64 are provided for locking the strip 63 in double thickness position (FIG. 5).

Figure 4:
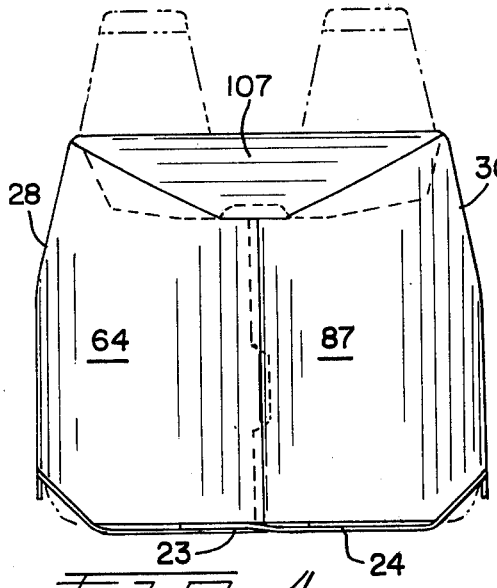
FIG. 4 is an end elevational view of the package of FIG. 1, to a larger scale.

The two panel forming sections 20 and 22 have formed therewith end wall closure forming panels of the type which are commonly referred to as "barn door" panels. Panel section 20 has a pair of generally rectangular end closing panels 64 and 65 formed along the sides of the blank, or the ends of the sidewall forming panel portion 28, which are separated therefrom by hinge forming longitudinal score lines 66, 67 extending from the opposite ends of the transverse score line 58 to the opposite ends of the transverse score line 15. The score lines 66, 67 are inclined slightly in an outboard direction and extend to points of intersection of line 15 with the longitudinal score lines 68, 70 which together with the transverse lines 15 and 16, define the top wall forming panel portion 72. The panels 64 and 65 are generally rectangular and have a dimension outboard of the score lines 66 and 67 which is somewhat greater than the diameter of the bottles so as to have the margins overlap when hinged to end closing position in the set up carton, FIG. 4. The panels 64 and 65 extend longitudinally of the blank at the hinge lines 66 and 67 between the score lines 58 and 15. They extend transversely of the blank 12 a distance corresponding approximately to the diameter of the bottle body, with the outboard edges defined by cutting lines 73 and 74. These cutting lines are such that small male locking or latching tab formations 75 and 76 are provided intermediate the ends of the lines 73 and 74. The cutting lines 73 and 74 are inclined inwardly in the direction of the center of the blank so that, when the panels are folded into end closing position, the lines 73 and 74 are approximately normal to the end edge forming fold lines 68 and 70 of the top wall forming panel 72, as shown in FIG. 4. Transverse cutting lines 77 and 78, forming bottom edges of the panels 64 and 65, extend outboard of the intersection of the ends of the transverse score line 58 with the longitudinal scorelines 66 and 67. The blank is cut on the lines 77 and 78 so that the inboard panel corners are notched out at 80 and 82 with the result that the panel bottom edges will be in approximate alignment with the end edges of the narrow panel 60 and the bottom wall panel 23 when in the closed position, as shown in FIG. 4. Transverse cutting lines 83 and 84 forming the top edges of the panels 64 and 65 extend outboard from the ends of the transverse score line 15 and are inclined outwardly in the direction of the end of the blank, with the outermost end portions configured to provide male locking or latching tab formations 85 and 86.

Panel forming section 22 is cut and scored to form the sidewall panel 30 and a pair of end closing panels 87 and 88 which are largely mirror images of the panels 64 and 65 and which are adapted to cooperate with the latter in forming the closed ends of the package. The panels 87 and 88 extend outboard of the score lines 90 and 82 which define the ends of the panel 30. The outboard dimension of these panels is somewhat greater than the corresponding dimension of the panels 64 and 65 so that marginal edge portions underlie edge portions of the panels 64 and 65 and the edge lines formed by the cutting lines 93 and 94 are spaced relative to the edge lines 73 and 74. The panels 87 and 88 are cut at the outboard margins on the edge forming lines 93 and 94 so as to provide female locking and latching slot formations 95 and 96 for cooperation with the tab formations 75 and 76 on the panels 64 and 65. Transverse cutting lines 97 and 98 extend from the ends of transverse score lines 53 and define the bottom edges of the panels 87 and 88. The lines 97 and 98 correspond to cutting lines 77 and 78 and provide notched out corner portions 100 and 102 corresponding to notched out portions 80 and 82. Transverse cutting lines 103 and 104 corresponding to cutting lines 83 and 84 provide latching and locking tab formations 105 and 106 for cooperation with the tab formations 85 and 86 and with locking panels extending from the top wall panel 72 as hereinafter described.

The center panel section 18 of the blank 12 is cut and scored to provide the rectangular top wall forming panel 72 which is defined by the longitudinal score lines 68, 70 and transverse score lines 15, 16. It has formed at opposite sides of the blank top end wall forming and locking panels 107 and 108 which are designed to be folded down so as to interlock the margins thereof with the main end wall forming panels 64, 87, and 65, 88 and cooperate with the locking and latching elements 75, 95 and 76, 96, thereby securely holding the end wall forming panels in position when the carton ends are closed. The panel portions 107 and 109 are of identical configuration and only panel 107 will be described in detail, the panel 108 at the opposite side of the blank being cut in like manner so as to constitute a mirror image of panel 107. Cutting lines 110 and 112 extend from the intersection of longitudinal score line 68 with the associated transverse score lines 15 and 16, in converging relation to the ends of the outboard edge forming longitudinal cutting line which comprises a center portion 113, parallel with and spaced outwardly of the hinge score line 68 and end portions 114 and 115, the latter being slanted inwardly in the direction of the ends of the blank. The cutting lines 110 and 112 cooperate with the cutting lines 83 and 103 in forming outwardly opening V-shaped notches 116 and 117 extending from apexes at the ends of score line 68.

The top wall panel 72 has cut therein a pair of spaced finger receiving holes 120 with hinged reinforcing tabs 122. The one sidewall panel 30 is provided with a conventional tear out arrangement indicated at 123 to facilitate opening the carrier for access to the bottles.

In applying the blank 12 to an assembly of the bottles, the top wall forming panel 72 will be centered on the neck portions of the bottle and the opposite ends of the blank folded down around the sides and bottom faces of the assembly. The divider partition 25 will have the edge reinforcing panel 63 folded upon adjoining portions thereof and the panel 24 will be swung into bottom wall forming position with the separator tabs 61 swung into position for seating between the bottles and with the divider panel 25 swung so as to move into row separating position. The associated bottom wall panel 23 will be swung into position in sequence and the locking panel 43 with the associated locking elements 46 will be manipulated as set forth in U.S. Pat. No. 3,589,593 so as to insert the elements 46 in the apertures 34 while drawing the wall panels tightly about the bottles.

Referring to FIGS. 12 to 15 of the drawings, there is illustrated a modification of the carrier carton for forming a six bottle package wherein the bottles have uppermost neck portions of somewhat different configuration and the top panel of the carrier rests on the top surface of the bottle closure caps C.

Figure 12:
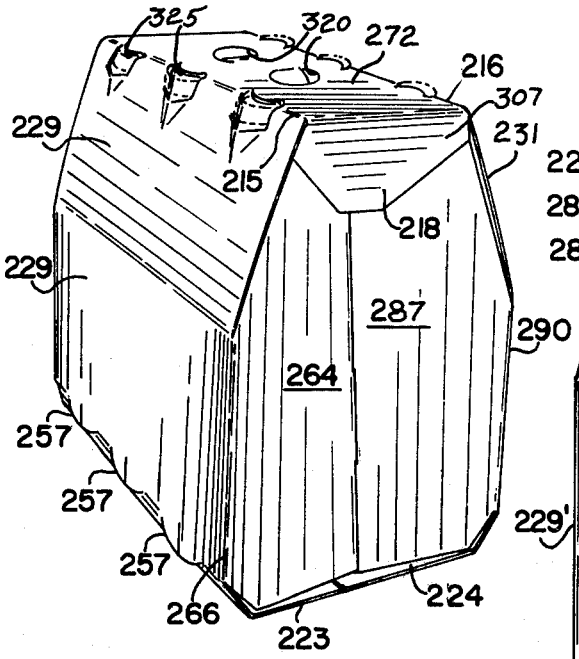
FIG. 12 is a perspective view of a modified form of the carrier package with full depth coverage of bottles of a slightly different configuration.
Figure 13:
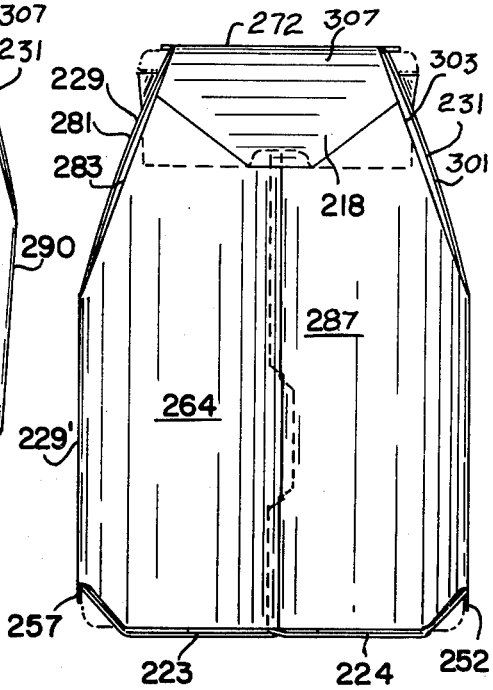
FIG. 13 is an end elevational view of the package of FIG. 12.
Figure 14:
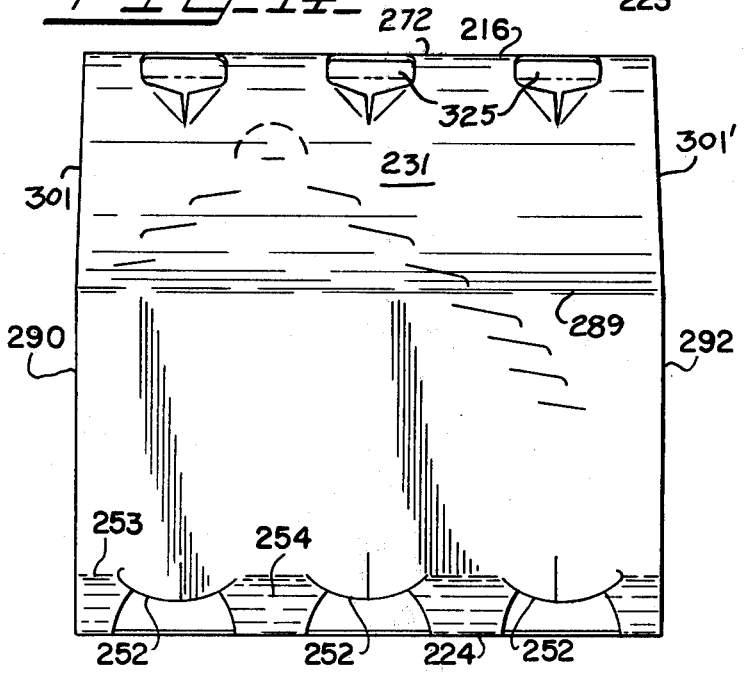
FIG. 14 is a side elevational view of the package of FIG. 12.
Figure 15:
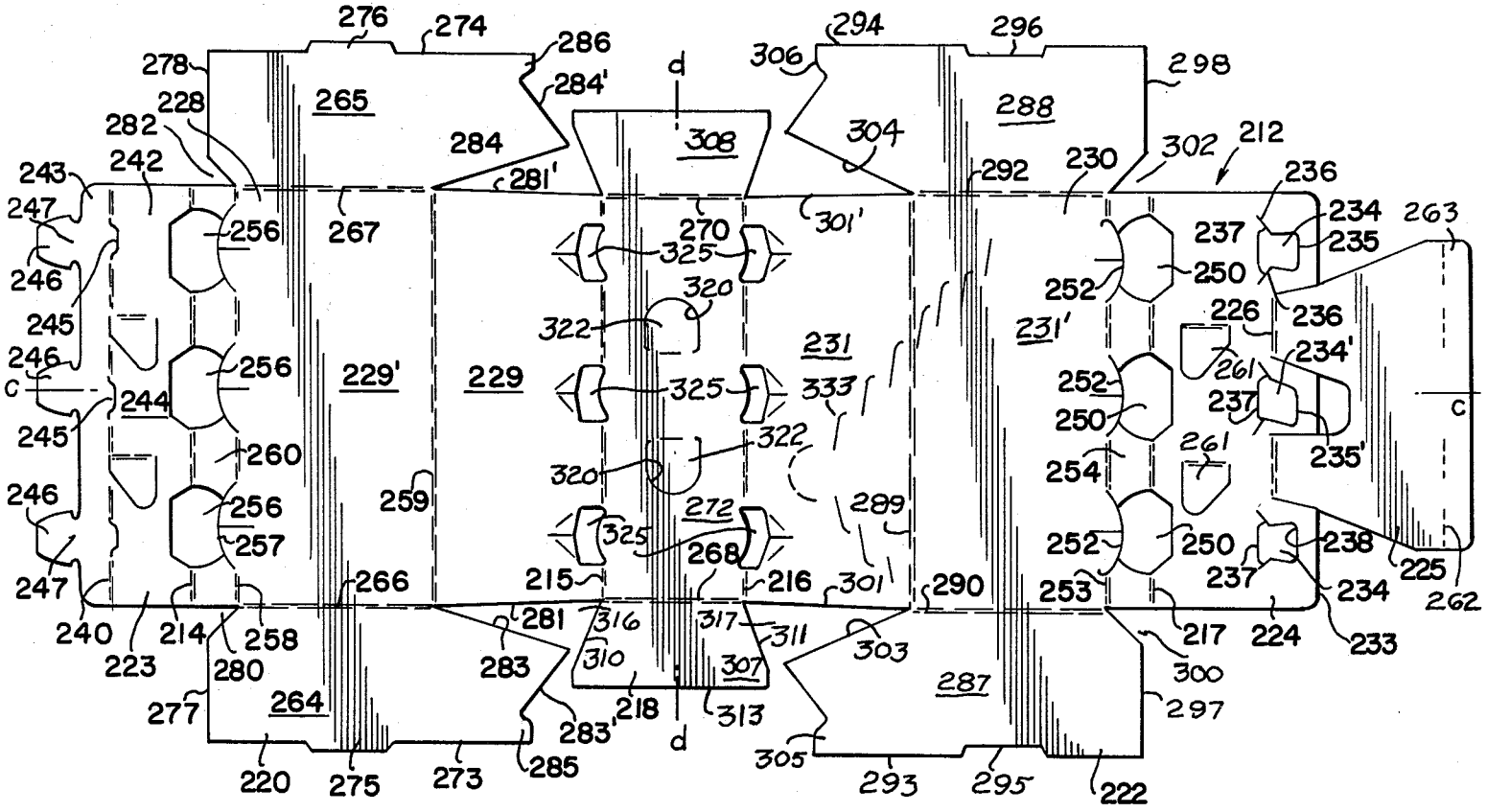
FIG. 15 is a plan view showing the outside of a blank which is cut and scored for wrappping about an assembly of bottles to form the package illustrated in FIG. 12.

The carton structure 210 which is illustrated in FIGS. 12 to 15 is formed by wrapping the cut and scored blank 212 of FIG. 15 about an assembly of the beverage bottles which are arranged in two rows of three bottles each with the bottles in transversely paired alignment, and with the bottles having elongated neck portions and conventional closure caps C. The blank 212 is paperboard, or equivalent foldable sheet material, of suitable gauge or weight, and is cut and scored as shown in FIG. 15. The blank 212 is similar to the blank 12 and is cut and scored in a similar manner so as to divide it into wall forming panels and associated panel connecting means, together with bottle movement restraining means. Except for certain details hereinafter referred to, the blank is symmertical about longitudinal and transversely extending center lines which are indicated at c—c and d—d in FIG. 15. It is divided on parallel, longitudinally spaced, transversely extending hinge forming crease or score lines 214, 215, 216 and 217, into top wall forming center panel section 218, adjoining sidewall forming panel sections 220 and 222, and bottom wall forming panel sections 223 and 224, the latter being at opposite end margins of the blank and panel 224 having a partition forming extension panel 225 cut and scored so as to enable it to hinge on a two part transversely extending hinge score line 226. The center panel section 218, in which a top wall and associated panels are formed, has a dimension in the direction longitudinally of the blank, and between the transverse score lines 215 and 216, which corresponds approximately to the distance between the vertical axes of a pair of transversely aligned bottles so that two rows of apertures 227 may be cut therein which are longitudinally and transversely spaced according to the bottle spacing and enable portions of the bottle caps to be seated therein as shown in FIG. 12. The dimensions of the sidewall forming panels 228 and 230 in the direction longitudinally of the blank, correspond generally to the height of the bottles. The transverse dimension of the bottom wall forming and panel sections 223 and 224, which support the bottles in the package corresponds approximately to the bottom dimension of the rows of bottles, when grouped as indicated in FIG. 14. The top wall forming panel section 218 and the adjoining sidewall forming panel sections 220 and 222 have an overall dimension transversely of the blank which is greater than the row dimension of the bottle assembly and these panels are subdivided, as hereinafter described, so as to provide along opposite sides of the blank hinged panel structures for closing the ends of the tubular carton which results when the blank 212 is folded and secured in bottle enclosing relation.

The bottom wall forming end panels 223 and 224 in the blank 212 have a dimension in the lengthwise direction of the blank which is sufficient to provide overlapping marginal portions, when the blank is wrapped about the bottle assembly and secured in carton forming position, and cooperating interengaging locking elements are cut in the two panels for securing the panels in wall forming relation and to provide a tight wrap about the bottle assembly. The bottom wall forming panel 224, which is rectangular in form, extends between the carton bottom corner forming score line 217 and the parallel edge defining line 233 of the panel and a plurality of spaced, transversely aligned latch receiving apertures 234 are cut therein, there being three in the illustrated form of the blank, which corresponds to the number of bottles in a row. The apertures or latch receiving openings 234, which may be termed the female locking elements, are each in the form of a truncated triangle. They are each defined by cutting lines, which may be as shown in U.S. Pat. No. 4,029,204 and in U.S. Pat. No. 3,670,950. Each latch opening or aperture 234 is defined by a generally U-shaped main cutting line 235 which opens inwardly of the panel 224 with short terminal leg portions 236 in diverging relation and with an inner connecting base line 237 extending transversely between the cutting lines 236 and spaced inwardly of the transversely extending base portion 238 of the U-shaped cutting line 235. The latch openings are identical except for the middle one 234' in which the U-shaped cutting line 235 has its leg portions tilted toward one side of the blank. The end panel section 223 at the opposite end of the blank 212 is divided by a transverse score line 240, which is parallel with the score line 214 and spaced therefrom, so as to provide a bottom wall forming portion 242 and a terminal latch bearing portion 243. The score line 240 is interrupted by a series of transversely spaced, relatively short cutting lines 244 which are generally C-shaped and extend into the panel 242, with the terminal ends thereof reversely curved, so as to form primary locking tabs 245. The tabs 245 are longitudinally aligned with female apertures 234, 234' for engagement in the latter at the outermost edges 238 thereof. Secondary locking or latching tabs, or fingers 246 are provided, in longitudinal alignment with the locking tabs 245, and have a configuration which includes a neck portion 247 of reduced width corresponding, approximately, to the width of the apertures 234, 234' at the inntermost edge 237 thereof. The locking and latching tabs and cooperating apertures may be formed as shown in U.S. Pat. No. 4,029,204; U.S. Pat. No. 3,598,593, granted June 29, 1971; and U.S. Pat. No. 3,432,029, granted Mar. 11, 1969.

The transverse score line 217, which defines the edge of the bottom wall forming panel 224, is interrupted by transversely spaced bottle movement restraining apertures 250, which are spaced according to the bottle spacing in the rows and which are longitudinally aligned in the blank with the locking and latching tabs 245 and 246. The innermost edge of each aperture 250 is defined by a curved cutting line 252 which is in the form of a segment of a circle and which is bowed in the direction of the end of the blank. These cutting lines interrupt a transverse score line 253 which is parallel with and spaced inwardly of the transverse score line 217 and which cooperates with the latter in forming a narrow bottom corner edge panel 254 in the final package. The apertures 250, in which bottom edge portions of the bottles seat, may be in the form shown in U.S. Pat. No. 4,029,204. At the other end of the blank 212, the bottom edge forming score line 214 is interrupted by transversely spaced bottle retaining apertures 256 which have inboard edges formed by outwardly bowed or curved cutting lines 257 which interrupt a transverse score line 258 spaced inwardly from, and parallel with, the score line 214 so as to form a narrow bottom edge panel 260. This arrangement is formed the same as the apertures 250 in panel 254 at the opposite end of the blank, and provides like bottle movement restraining means for the row of bottles on that side of the assembly. The bottom wall forming panels 223 and 224 are each cut and scored to provide hinged separator tabs 261 which are spaced according to the spacing of the bottles in the rows and which may be formed as shown in U.S. Pat. No. 4,029,204. These tabs are hinged upwardly for disposition as separators between the bottles at the bottoms thereof.

The partition forming panel 225 which constitutes an extension portion on the panel 224, is of lesser transverse dimension than the panel 224, and is adapted to form a divider between the rows of bottles the same as shown in FIGS. 5 and 6, the transverse dimension being somewhat greater than the distance between the vertical axes of the end bottles in each of the rows. The panel 225 is cut so as to have a generally U-shaped configuration with the main portion extending outboard of the cutting line 233 and the leg formations thereof cut in part from the material between the endmost latch apertures 234 and the middle aperture 234'. This panel is adapted to hinge on the two section transversely spaced score line 226 which is parallel with and spaced from the score line 217, so that, when the panel 225 is hinged to upright position relative to panel 224, it will be disposed between the two rows of bottles. A score line 262 sets off a narrow marginal strip 263 which is adapted to be reversely folded so as to provide a double thickness of material at the margin.

The two panel forming sections 220 and 222 have formed therein sidewall panels and end wall closure forming panels. The panel section 220 has a pair of generally rectangular end closing panels 264 and 265 formed along the sides of the blank, or the ends of the sidewall forming panel portion 228, which are separated therefrom by hinge forming longitudinal score lines 226 and 267 which are parallel and extend from the opposite ends of the transverse score line 258 to the opposite ends of the transverse score line 259, the latter being parallel with and spaced intermediate the transverse score lines 258 and 215 so as to divide the panel 228 into top and bottom side wall panel section 229 and 229'. The panels 264 and 265 are generally rectangular and have a dimension outboard of the score lines 266 and 267 which is somewhat greater than the diameter of the bottles so as to have the margins overlap when hinged to end closing position in the set up carton, FIGS. 12 and 13. The panels 264 and 265 extend longitudinally of the blank at the hinge lines 266 and 267 between the score lines 258 and 259. They extend transversely of the blank 212 a distance corresponding approximately to the diameter of the bottle body, with the outboard edges defined by cutting lines 273 and 274. These cutting lines are such that small male locking or latching tab formations 275 and 276 are provided intermediate the ends of the lines 273 and 274. The cutting lines 273 and 274 are parallel with the score lines 266 and 267 so that, when the panels are folded into end closing position, the lines 273 and 274 are approximately normal relative to the end edge forming fold lines 268 and 270 of the top wall forming panel 272, as shown in FIG. 13, which fold lines 268 and 270 extend between opposite ends of the score lines 215 and 216 and define with them the top wall panel 272. Transverse cutting lines 277 and 278, forming bottom edges of the end wall panels 264 and 265, extend outboard of the intersection of the ends of the transverse score line 258 with the longitudinal scorelines 266 and 267. The blank is cut on the lines 277 and 278 so that the inboard panel corners are notched out at 280 and 282 with the result that the panel bottom edges will be in approximate alignment with the end edges of the narrow panel 260 and the bottom wall panel 223 when in the closed position, as shown in FIGS. 12 and 13. Longitudinal cutting lines 281 and 281' extend between corresponding ends of the transverse score lines 259 and 215 which are at a small angle inwardly toward the center of the blank and the top wall panel 272 which define the end edges of the top sidewall panel section 229. Transverse cutting lines 283 and 284 which form the top edges of the panels 264 and 265 extend outboard from the ends of the transverse score line 259 and are inclined outwardly in the direction of the remote end of the blank, with the outermost end portions 283' and 284' reversely turned and configured to provide male locking or latching tab formations 285 and 286. The cutting lines 283 and 284 are angled outwardly relative to the end edge forming lines 281 and 281' so that when the package is formed, these edges have approximately the same angle as the plane of the upper sidewall section 229 and will lie immediately adjacent to the innerface of the end margins of the panel section 229 as shown in FIG. 13.

Panel forming section 222 is cut and scored to form the sidewall panel 230 and a pair of end closing panels 287 and 288 which are largely mirror images of the panels 264 and 265 which are adapted to cooperate with the latter in forming the closed ends of the package. The panels 287 and 288 extend outboard of the longitudinal score lines 290 and 292 which are parallel and extend from the opposite ends of transverse score line 253 to corresponding opposite ends of transverse score line 289, the latter being parallel with and spaced intermediate the transverse score lines 216 and 253 so as to divide the sidewall forming panel 230 into top and bottom portions 231 and 231'. The outboard dimension of the panels 287 and 288 is somewhat greater than the corresponding dimension of the panels 264 and 265 so that marginal edge portions thereof underlie edge portions of the panels 264 and 265 and the edge lines formed by the cutting lines 293 and 274. The panels 287 and 288 are cut at the outboard margins on the edge forming lines 293 and 294 so as to provide female locking and latching slot formations 295 and 296 for cooperation with the tab formations 275 and 276 on the panels 264 and 265. Transverse cutting lines 297 and 298 extend from the ends of transverse score lines 253 and define the bottom edges of the panels 287 and 288. The lines 297 and 298 correspond to cutting lines 277 and 278 and provide notched out portions 280 and 282. Longitudinal cutting lines 301 and 301' extend between corresponding ends of transverse score lines 216 and 289 which are angled inwardly relative to the top wall forming panel and define the end edges of the sidewall top portion 231. Transverse cutting lines 303 and 304 which correspond to cutting 283 and 284 with the inner portions thereof, angled outwardly and in the direction of the center panel section 218. The cutting lines 283 and 284 are formed so as to provide latching and locking tab formations 285 and 286 and with locking panels extending from the top wall panel 272 for holding the end wall panels in closed position as hereinafter described.

The center panel section 218 of the blank 212 is cut and scored to provide the rectangular top wall forming panel 272 which is defined by the longitudinal score lines 268, 279 and transverse score lines 215, 216 has formed at opposite sides of the blank top end wall forming and locking panels 307 and 308 which are designed to be folded down so as to interlock the margins thereof with the top margins of the end wall forming panels 264, 287 and 265, 288 and to cooperate with the locking and latching elements 275, 295 and 276, 296 and securely hold the end wall forming panels in position when the carton ends are closed. The panel portions 307 and 308 are of identical configuration and only panel 307 will be described in detail, the panel 308 at the opposite side of the blank being cut in like manner so as to constitute a mirror image of panel 307. Cutting lines 310 and 312 extend from the intersection of longitudinal score line 268 with the associated transverse score lines 215 and 216, in diverging relation to the ends of the outboard edge forming longitudinal cutting line 313 which is parallel with and spaced outwardly of the hinge score line 268. The cutting lines 310 and 312 cooperate with the cutting lines 281 and 301 in forming outwardly opening V-shaped notches 316 and 317 extending from apexes at the ends of score line 268.

The transverse score lines 215 and 216 are interrupted by apertures 325, spaced according to the spacing of the bottles, for receiving outboard portions of the bottle caps so that when seated therein, the bottles are restained against movement at the tops thereof.

The top wall panel 272 has cut therein a pair of spaced finger receiving holes 320 with hinged reinforcing tabs 322. The one sidewall panel 230 is provided with a conventional tear out arrangement indicated at 333 to facilitate opening the carrier for access to the bottles.

In applying the blank 212 to an assembly of the bottles, the top wall forming panel 272 will be centered on the top portions of the bottle and the opposite ends of the blank folded down around the sides and bottom faces of the assembly. The divider partition 225 will have the edge reinforcing panel 262 folded upon adjoining portions thereof and the panel 224 will be swung into bottom wall forming position with the separator tabs 261 being swung into position for seating between the bottles and with the divider panel 225 swung so as to move into row separating position. The associate bottom wall panel 223 will be swung into position in sequence and the locking panel 243 with the associated locking elements 246 will be manipulated as set forth in U.S. Pat. No. 3,589,593 so as to insert the elements 246 in the apertures 234 while drawing the wall panels tightly about the bottles.

The end wall top locking panels 307 and 038 will be folded down on the hinge lines 268 and 270 followed by the panels 264, 265 and 287, 288 which will be folded on the hinge lines 266, 267 and 290, 292 with the latch elements 275 and 276 engaging in the cooperating slots 295 and 296 and with the top locking tabs 285, 305 and 286, 306 being brought together and forced into underlying relation with the free margins of the respective top locking panels 307 and 308.

In the final end wall or end closing position in both forms of the package shown the end panel structures are in effect bowed inwardly in both the top and center areas so as to hug the surface of the end pair of bottles with the exposed edges set inwardly of the plane of the end edges of the top, side and bottom wall panels where there is minimum risk of these structures being accidently torn open during handling of the packages.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A carrier package comprising an assembly of articles, in the form of bottles, arranged in a double row and in transversely aligned pairs, enclosed in a tubular carton formed from a single blank of paperboard or similar foldable sheet material, said carton having a top wall panel, integrally hinged sidewall forming panels depending from side edges of said top wall panel and extending along the oppositely disposed outer side faces of the article assembly, bottom wall forming panels integrally hinged to the bottom edges of said sidewall panels and extending inwardly toward each other with overlapped margins, which margins of said bottom wall forming panels have cooperating means securing the panels together, end wall forming panels integrally hinged to the ends of said sidewall panels and said top wall panel which are disposed in end closing relation at opposite ends of the tubular carton, said top end wall panels being free of the sidewall panels and being hinged downwardly and inwardly to a position adjacent the top portions of the endmost pair of bottles, said side end wall panels having top edges tapered inwardly and downwardly and having top marginal portions overlying free marginal portions of said top end wall panels and said end wall panels hinged to said side wall panels having inner vertical margins disposed in overlapping relation and having dual latch means interengaged with each other and with said top end wall panel securing said panels in end closing position.

2. A carrier package as set forth in claim 1 wherein said latch means on said end wall panels comprises a slot formation in one of said end wall panels and a latch tab on the associated end wall panel which engages in said slot formation.

3. A carrier package as set forth in claim 1 wherein said latch means on said end wall panels which are hinged to said side wall panels comprises projecting tab formations at the top corners of said end wall panels which tab formations extend beneath the bottom margin of the associated top end wall panels.

4. A carrier package as set forth in claim 1 wherein the sidewall forming panels have a top portion disposed in inwardly and upwardly inclined position, said end wall panels which are hinged to said side wall panels being free of the inclined top portion of the associated side wall forming panel and being disposed in inwardly folded relation with the top margin thereof overlying the outer face of the associated top end wall panel and including at the inner edge thereof a tab formation disposed in engagement beneath the free margin of said top end wall panel.

5. A blank of paperboard, or other foldable sheet material of similar character which is adapted for wrapping about a group of articles having the form of bottles arranged in double row transversely paired relation, which blank is generally rectangular and divided into a series of wall panel forming sections, by longitudinally spaced, parallel, hinge forming score lines, said wall panel forming sections each comprising a top wall and end wall panel forming center section, adjoining sidewall and end wall panel forming sections and bottom wall panel forming sections at opposite ends of the blank, said bottom wall panel forming sections having a combined dimension in the lengthwise direction of the blank which is greater than the transverse dimension of the group of articles so as to enable the free end margins thereof to be overlapped and secured together when the blank is folded into tubular carton forming relation about the group of articles, said bottom wall forming panel sections having a dimension in the direction transversely of the blank which is slightly greater than the combined dimension of the articles in a row, said center panel section and said adjoining panel forming sections having a dimension transversely of the blank which exceeds the combined dimension of the articles in a row, each of said adjoining panel forming sections being subdivided by transversely spaced longitudinally extending hinge forming score lines into a sidewall forming panel and end wall forming panels which end wall forming panels are disposed along opposite side margins of the blank, said center section of the blank being subdivided by hinge forming score lines into a rectangular top wall forming panel and end wall locking panels at opposite ends thereof, which end wall locking panels extend along opposite of the blank and outboard of the ends of the top wall forming panels, and said end wall forming panels each having at the outer margin a locking tab for interlocking engagement with portions of the end wall forming panels when the blank is formed into a tubular carton and the end wall panels are hinged to end closing position with marginal portions of the end wall locking panels underlying in part the margins of said end wall forming panels.

6. A blank as set forth in claim 5 wherein said end wall forming panels and said end wall locking panels are dimensioned so as to cooperate in completely closing the ends thereof when the blank is folded into tubular carton forming relation.

7. A blank as set forth in claim 5 wherein said end wall forming panels have a dimension in the direction transversely of the blank which enables the marginal portions to be overlapped and inwardly bowed when the carton is formed with the end wall panels hinged into end closing relation.

8. A blank as set forth in claim 7 wherein said end wall locking panels each have a dimension in the direction transversely of the blank which enables the marginal portion to be overlapped by marginal portions of the cooperating end wall forming panels when the carton is formed and each of said end wall forming panels having a locking slot at the edge thereof for interengagement with said locking tab on the associated end wall forming panel.

9. A blank as set forth in claim 7 wherein said end wall forming panels each have a tab formation projecting from the corner at the top forming edge which adjoins the top wall forming panel for cooperation with the associated locking panel when the carton is formed so as to latch the panels in position.

10. A carrier package comprising an assembly of articles, in the form of bottles, arranged in a double row and in transversely aligned pairs and enclosed in a tubular carton formed from a single blank of paperboard or similar foldable sheet material, said carton having a top wall panel, integrally hinged sidewall forming panels depending from said edges of said top wall panel and extending along the oppositely disposed outer side faces of the article assembly, bottom wall forming panels integrally hinged to the bottom edges of said sidewall panels and extending inwardly toward each other with overlapped margins, which margins of said bottom wall forming panels have cooperatin interengaging locking and latching means securing the panels together in tightly drawn relation, end wall forming panels integrally hinged to the ends of said sidewall panels and said top wall panel which are disposed in end closing relation at opposite ends of the tubular carton, said top end wall panels being free of the sidewall panels and being hinged downwardly and inwardly to a position adjacent the top portions of the endmost pair of bottles with marginal end edges disposed adjacent the inside faces of said sidewall panels, said end wall panels hinged to the side wall panels having top edges tapered inwardly and downwardly and having top marginal portions overlying free marginal portions of said top end wall panels and said end wall panels hinged to said side wall panels having inner vertical margins disposed in overlapping relation and having latch means on the vertical edges interengaged with each other and latch means projecting upwardly of the top margins interlocked with said top end wall panel securing said panels in end closing position.

11. A carrier package as set forth in claim 10 wherein said latch means on the vertical edges of said end wall panels at each end of the carton comprises a slot formation in one of said end wall panels and a latch tab on the associated end wall panel which is engaged in said slot formation.

12. A carrier package comprising an assembly of articles in the form of bottles, arranged in a double row and in transversely aligned pairs and enclosed in a tubular carton formed from a single blank of paperboard or similar foldable sheet material, said carton having a top wall panel, disposed on the top portions of the bottles, integrally hinged sidewall forming panels depending from side edges of said top wall panel and extending along the oppositely disposed outer side faces of the bottle assembly, said side wall panels having lower portions disposed in spaced generally vertical planes and top portions slanted inwardly to a junction with said top wall panel at the top of the bottles, bottom wall forming panels integrally hinged to the bottom edges of said sidewall panels and extending inwardly toward each other with overlapped margins, which margins of said bottom wall forming panels have cooperating interengaging locking and latching elements securing the panels together in tightly drawn relation, end wall forming panels integrally hinged to the ends of the lower portions of said sidewall panels which are hinged inwardly to end closing position, end wall latching panels integrally hinged to said top wall panel being free of the sidewall panels and being hinged downwardly and inwardly to a position adjacent the top portions of the endmost pair of bottles, said end wall panels hinged to said side wall panels having top edge portions which taper inwardly and upwardly and having top marginal portions overlying free marginal portions of said top end wall latching panels and said end wall panels hinged to said sidewall panels having inner vertical margins disposed in overlapping relation and having vertically spaced latch means interengaged with each other and with said top end wall panel securing said panels in end closing position and in inwardly bowed relation so that inner portions are disposed inwardly of the vertical plane in which the terminal end edges of the top, side and bottom wall panels lie.

* * * * *

UNITED STATES PATENT AND TRADEMARK OFFICE

CERTIFICATE OF CORRECTION

PATENT NO. : 4,314,640

DATED : February 9, 1982

INVENTOR(S) : Guelfo A. Manizza

It is certified that error appears in the above—identified patent and that said Letters Patent is hereby corrected as shown below:

Column 9, line 65, delete "226" and insert therefor -- 266 --.

Column 11, line 53-54, delete "restained" and substitute therefor -- restrained --.

Column 12, line 10, delete "038" and substitute therefor - 308 --.

Column 13, line 58, after "opposite" insert -- margins --.

Column 14, line 37, delete "cooperatin" and substitute therefor -- cooperating --.

Signed and Sealed this

*Eleventh* Day of *May 1982*

[SEAL]

*Attest:*

GERALD J. MOSSINGHOFF

*Attesting Officer*

*Commissioner of Patents and Trademarks*